United States Patent [19]

Iida et al.

[11] Patent Number: 4,748,944

[45] Date of Patent: Jun. 7, 1988

[54] REED VALVE DEVICE FOR 2-CYCLE ENGINE

[75] Inventors: Fumiyoshi Iida, Iwata; Kazutoshi Takahashi, Hamamatsu, both of Japan

[73] Assignee: Suzuki Jidosha Kogyo Kabushiki Kaisha, Shizuoka, Japan

[21] Appl. No.: 99,608

[22] Filed: Sep. 22, 1987

[30] Foreign Application Priority Data

Sep. 24, 1986 [JP] Japan ..... 61-223857

[51] Int. Cl.[4] ..... F02B 33/04

[52] U.S. Cl. ..... 123/73 V; 137/856; 251/285

[58] Field of Search ..... 123/73 V, 65 V; 137/847, 852, 855, 856; 251/285

[56] References Cited

U.S. PATENT DOCUMENTS

| | | | |
|---|---|---|---|
| 1,494,176 | 5/1924 | Little | 137/856 |
| 4,076,047 | 2/1978 | Akahori | 137/856 |
| 4,195,660 | 4/1980 | Taipale et al. | 137/856 |
| 4,423,706 | 1/1984 | Onodera | 123/52 M |
| 4,696,263 | 9/1987 | Boyesen | 123/65 V |

FOREIGN PATENT DOCUMENTS

| | | | |
|---|---|---|---|
| 46-36850 | 10/1971 | Japan . | |
| 58-40649 | 9/1983 | Japan . | |
| 0095132 | 5/1985 | Japan | 123/65 V |

*Primary Examiner*—Charles J. Myhre
*Assistant Examiner*—David A. Okonsky
*Attorney, Agent, or Firm*—Flynn, Thiel, Boutell & Tanis

[57] ABSTRACT

A reed valve device for a 2-cycle engine includes a valve housing having several ports extending thereinto from a surface thereof. Several reed valves each have one end secured to the housing and can move between a position spaced from the surface and a position disposed against the surface and obstructing a respective port. Two main shafts are rotatably supported on the housing, and are coupled for synchronous rotation by a gear plate arrangement. Each main shaft has thereon a stopper which can move between positions engaging and spaced from the reed valve in response to rotational movement of the associated shaft, engagement of a stopper and a reed valve effecting an increase in a spring constant of the reed valve. When the engine exceeds a predetermined speed, a motor rotates the shafts to move the stoppers into engagement with the reed valves.

6 Claims, 3 Drawing Sheets

REED VALVE DEVICE FOR 2-CYCLE ENGINE

FIELD OF THE INVENTION

This invention relates to a reed valve device for a 2-cycle engine, and more particularly relates to such a reed valve in which the spring constant of the reed valve can be adapted to be changed in accordance with the operative state of the engine.

BACKGROUND OF THE INVENTION

A reed valve which acts as a stopper valve has been used in an air intake passage of a 2-cycle engine. Such a reed valve is preferably used because of its simple structure and minimal leakage of air-fuel mixture.

FIG. 6 is a sectional end view illustrating an engine containing an existing reed valve, wherein reference numeral 1 represents an air intake passage. The air intake passage 1 communicates with a crank chamber 3 which in turn communicates with a combustion chamber or cylinder 2. Two valve seats 4, which each have a frame-like shape and face the crank chamber 3, are disposed in a V-shaped manner at the lower end portion of the air intake passage 1. Reed valves 5 are each secured to one side end of a respective one of the valve seats 4 and are arranged to oppose each other. A respective stopper member 6 is, as illustrated, secured to one end of each reed valve 5 in a manner yielding a somewhat laminated arrangement so that this stopper member 6 regulates the lift (degree of opening) of the reed valve 5.

A carburetor (omitted from illustration) supplies an air-fuel mixture to a location upstream of the reed valves 5 in the aforesaid air intake passage 1, while an exhaust port 7, a scavenge port 8 and an intake port 9 which communicates with the air intake passage 1 are bored in the cylinder 2, which ultimately receives the air-fuel mixture. These ports are opened and closed by reciprocation of an opening piston shown in broken lines at 10. That is, at a lower dead center position of the piston 10, the exhaust port 7 and the scavenge port 8 open, while at a top dead center position, the intake port 9 opens. Reference numeral 11 represents a crank shaft, reference numeral 12 represents a crank wheel and reference numeral 13 represents a crank pin.

When the piston 10 rises, the air pressure in the crank chamber 3 becomes negative, whereby the free end of the reed valves 5 open so as to take the air-fuel mixture into the crank chamber 3. A part of the air-fuel mixture is taken into the crank chamber 3 through the air intake port 9 at a position near the top dead center position of the piston 10. When the piston 10 is then lowered, the air pressure in the crank chamber 3 changes to positive, whereby the reed valves 5 are restored to their original closed positions so as to close the air intake passage 1, whereby the air-fuel mixture in the crank chamber 3 is compressed. When the piston 10 nears the lower dead center position, the scavenge port 8 opens, whereby the air-fuel mixture in the crank chamber 3 is pressed into the cylinder 2. During the next rising of the piston 10, the next quantity of the air-fuel mixture is taken into the crank chamber 3 while the air-fuel mixture already in the cylinder 2 is compressed and then sparked for burning, whereby the piston 10 is forcibly lowered so as to drive the crank shaft 1, to compress gases in the crank chamber 3, and to open the exhaust port 7 and exhaust the gases at a position adjacent to the lower dead center position of the piston just prior to the scavenging stroke.

The reed valve device acts to regulate the air intake passage 1 to open and close it in accordance with the reciprocation of the piston 10. The device, therefore, is an important factor for the air intake efficiency, which is the important factor for the engine power output when the quantity of the air-fuel mixture is too small or large. The size, shape, material and so forth of the valve are therefore properly designed in accordance with the response and resistance at the time of taking in air and so forth. However, the following problems between the relationship between the spring constant of the reed valve and the engine speed are raised.

FIG. 7 illustrates the relationship between the engine power output (vertical axis) and engine speed (lateral axis). The characteristics change as shown by the curve A (short dashed line) when a reed valve having a small spring constant is used, while they change as shown by curve B (alternate long and short dash line) when a reed valve having a relatively large spring constant is used. As can be clearly seen from this figure, the curve A shows a good response to the relatively slow flow of the air-fuel mixture in the low and lower intermediate speed ranges of the engine, whereby high power can be obtained. However, it shows a rapid reduction in output (jumping of the reed valve) at the point of entrance to the high rotational speed range, because of natural vibration. Although it eventually restores much of the output, it is not stable, and total output consequently decreases. On the other hand, a reed valve having a large spring constant can avoid the aforesaid lowering of output in the upper intermediate and high speed ranges because of natural vibration. However, since sufficient opening or lift cannot be obtained in the low and lower intermediate ranges, total output decreases as shown by the curve B.

In order to overcome the aforesaid problems, a device in which the spring constant of the reed valve is small at low and lower intermediate engine speeds and is large at upper intermediate and high engine speeds has been disclosed, for example in Japanese Patent Publication Nos. 36850/1971 and 40649/1983. According to these prior devices, although such problems can be solved, the mechanism for regulating the spring constant is complicated and large, or reliability in sealing accuracy of the reed valve and durability are not sufficient.

Thus, in such a reed valve device, the spring constant of the reed valve needs to be small in the low and intermediate engine speed ranges, while it needs to be large in the intermediate and high speed ranges. Some prior mechanisms can meet these requirements, but are difficult or complicated to adjust, or else the accuracy, durability and cost thereof are sometimes insufficient.

An object of the present invention is to provide for a 2-cycle engine a reed valve device capable of overcoming the aforesaid problems, in which a reed valve having a small spring constant is used, whereby it can respond from the low speed to high speed ranges for the purpose of optimizing the engine output.

SUMMARY OF THE INVENTION

The reed valve device for a 2-cycle engine according to the present invention comprises stoppers which are adapted to be freely movable between positions in contact with and separated from a surface of the reed valve and which are provided on a pair of main shafts, and a gear plate arrangement which is adapted to make the pair of the main shafts rotate in a synchronized manner, whereby the aforesaid stoppers are usually separated from the reed valves and are brought into contact with the reed valves by application of a rotational force to each of the main shafts when the engine rotates at upper intermediate and high speeds.

According to the inventive reed valve device just described, the reed valves open and close with a small spring constant due to separation therefrom of the stoppers for the purpose of not restricting the reed valves in the low and lower intermediate engine speed ranges, whereby high engine output can be achieved in these ranges. When in the upper intermediate and high engine speed ranges, a rotational force is applied to the main shafts, and the stoppers which move in accordance with the main shafts are brought into contact with the reed valves. The effective length of each reed valve becomes short, namely extending from the contact position with the stopper to the free end, as a result of which the spring constant becomes large. Therefore, the rapid reduction in output caused from natural vibration of a reed valve having a small spring constant can be prevented and, furthermore, intake air interference in the high engine speed range can be prevented.

BRIEF DESCRIPTION OF THE DRAWINGS

Embodiments according to the present invention will now be described with reference to the accompanying drawings, in which:

FIG. 6 is a sectional end view of a prior 2-cycle engine; and

DETAILED DESCRIPTION

Figure 1:
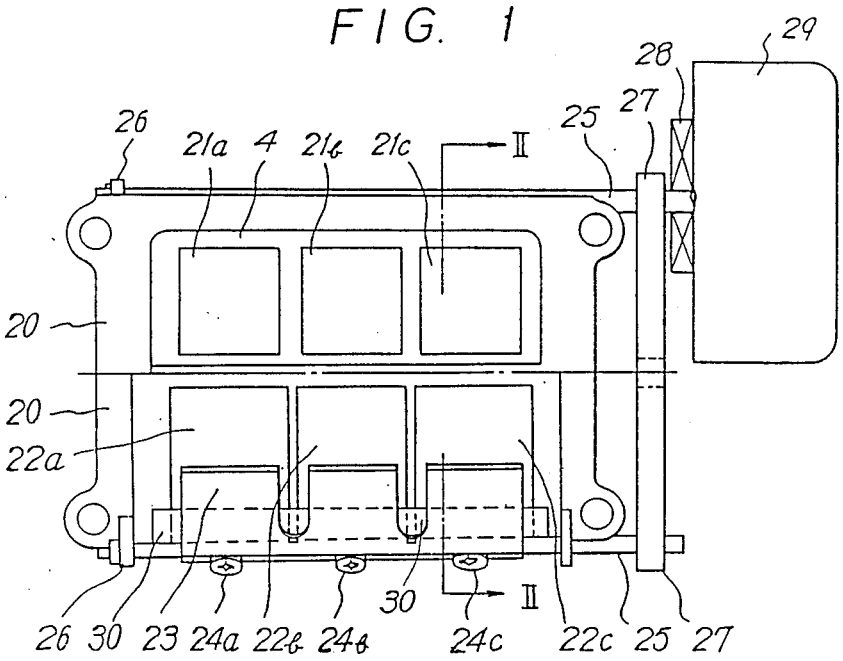
FIG. 1 is a diagrammatic view illustrating one embodiment of a reed valve device for a 2-cycle engine which embodies the present invention, wherein certain components including a reed valve and stopper are omitted from the upper half of the figure.
Figure 2:
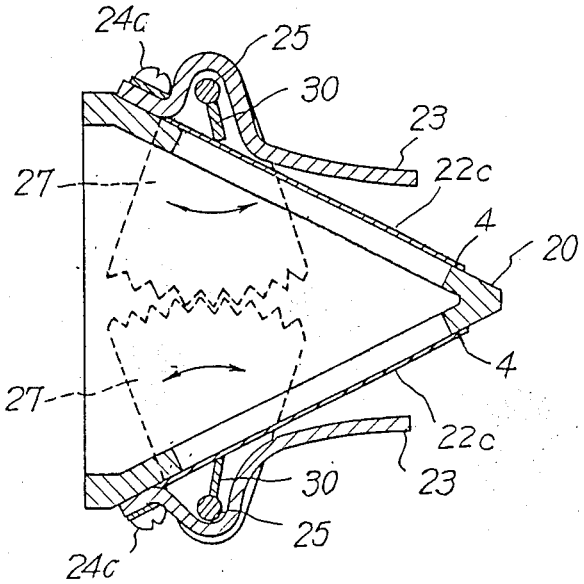
FIG. 2 is a sectional view taken along the line II—II in FIG. 1 and showing selected components of the embodiment of FIG. 1.

FIGS. 1 and 2 illustrate a reed valve device for a 2-cycle engine according to the present invention, wherein a valve housing composed of two housing parts 20 has a V-shaped cross-section and is adapted to be disposed in a transverse manner in a not-illustrated conventional air intake passage. A plurality of ports 21*a*, 21*b* and 21*c* are bored through the V-shaped portion of each valve housing part 20 in a parallel manner. A framelike-shaped valve seat 4 is disposed around the ports 21*a*, 21*b* and 21*c*. The valve seat 4 is disposed flush with the surface of the V-shaped housing. Two sets of reed valves 22*a*, 22*b* and 22*c* are laminated on respective stopper members 23, and the reed valves and stopper members are secured by screws 24*a*, 24*b* and 24*c* to the housing parts 20 adjacent opposite ends of the valve seat 4. Two main shafts 25 are respectively disposed adjacent to the respective sets of reed valves 22*a*, 22*b* and 22*c* at the outer ends of the valve housings 20. One end of each of the main shafts 25 is journaled in a respective bearing 26, while the other ends are connected to respective gear plates 27, and one of the shafts 25 is connected to a motor 29 through a shaft seal 28.

Figure 3:
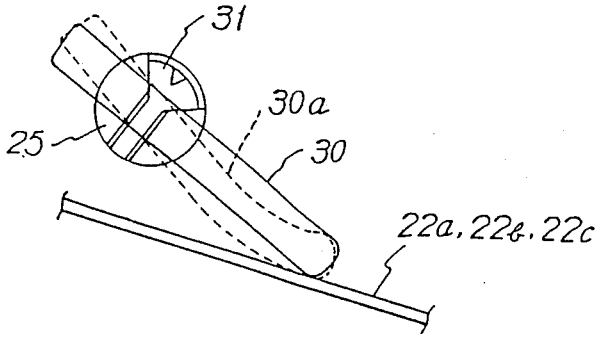
FIG. 3 is a diagrammatic view which illustrates the operation of a stopper which is a component of the embodiment of FIG. 1.
Figure 4:
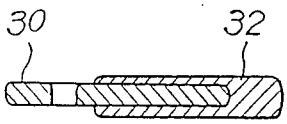
FIG. 4 is a sectional view of an alternative embodiment of the stopper according to the invention.

Between the aforesaid main shafts 25 are, as shown in FIG. 2, interposed the gear plates 27. These gear plates 27 are in toothed engagement with each other so as to be pivoted in the directions designated by the arrows in FIG. 2 by the rotation force imparted by the motor 29 through one of the main shafts 25. This engagement and pivotal movement cause the main shafts 25 to rotate in a synchronized manner. Therefore, the rotational force imparted by the motor 29 causes the main shafts 25 to be moved in a synchronized relationship with respect to each other. That is, the rotational force of the motor is continuously and effectively transmitted to both of the two main shafts. On the other hand, stoppers 30 are provided on the main shafts 25 and these stoppers 30 may, for example, be secured thereto by a screw 31 (FIG. 3) or be integral therewith. The stoppers 30 are each formed by a member 30*a* made of a flexible material which can bend in the manner shown by a dashed line in FIG. 3 for the purpose of absorbing backlash between the gear plates 27, or any error in assembly, when a rotational force is imparted to the main shafts 25. For example, each can be formed of a resin, spring steel, or the like, or more preferably, as shown in FIG. 4, can be covered with a plastic material 32 such as rubber or a similar material. If the stoppers 30 are made of a rigid material, they cannot function as a supporting point at a time of changing in a forced manner the spring constant of the reed valve due to the aforesaid backlash and so forth. Forming the stoppers 30 of the flexible material, or covering them with the plastic material 32, is intended to obtain the following effect. That is, if one, of the stoppers acts as a supporting point at the time of changing the spring constant of the reed valve in a forced manner, while the other stopper does not act as a supporting point at the time of changing the spring constant of the reed valve, when the rotational force of the motor causes the contacting force of the stopper which acts as a supporting point to increase further, that force is transmitted to the other stopper and consequently both stoppers act as a supporting point for the reed valves.

Figure 5:
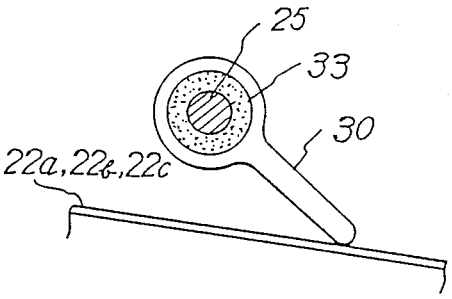
FIG. 5 is a diagrammatic view similar to FIG. 3 which illustrates a main shaft and stopper of a further alternative embodiment.

In the case where a stopper cannot act as a supporting point at the time of changing the spring constant of the reed valve in the aforesaid manner, provision of a damper 33, as shown in FIG. 5, between the main shaft 25 and the stopper 30 is helpful in allowing the stopper 30 to move smoothly without any unnecessary application of the rotation force to the main shaft 25.

In a reed valve device structure for 2-cycle engines of the kind described above, during the low speed and lower intermediate speed range of the engine the motor 29 positions the stoppers 30 at positions where they are not in contact with the reed valves 22*a*, 22*b* and 22*c*. The motor 29 is adapted to be operated in an upper intermediate and high speed range of the engine, namely above a predetermined value in accord with a signal received from a speed sensor which detects the rotational speed of the engine or in accord with a throttle opening sensor which detects the degree of opening of the throttle (both sensors being conventional and omitted from the drawings). When the motor 29 is thus operated, a rotational force is transmitted to the main shafts 25 through the gear plates 27. The stoppers 30 are then brought into contact with the reed valves 22a, 22b and 22c by the rotation of the main shafts 25. Consequently, they act as supporting points at the time of changing the spring constant of the reed valves 22a, 22b and 22c. The operational region of the stoppers 30 is adapted to include the upper intermediate and high speed ranges in which it is difficult for the opening and closing operation of the reed valves 22a, 22b and 22c to be made to correspond with the rotational speed of the engine because of natural vibration.

Figure 7:
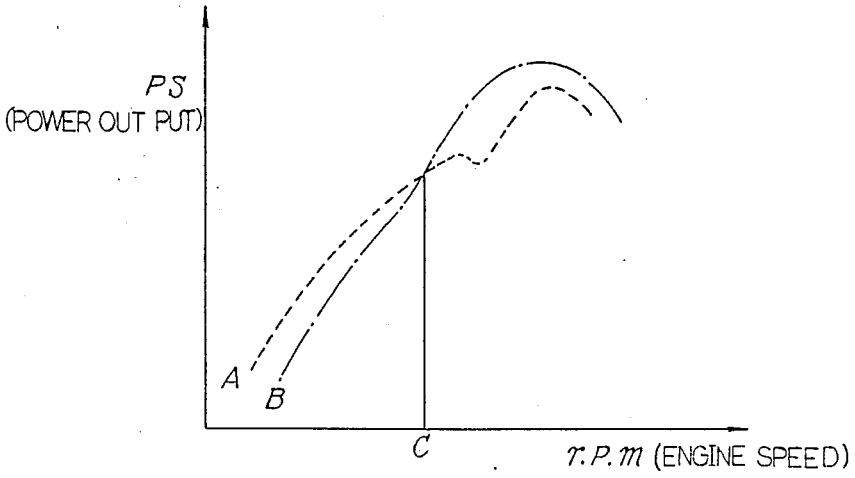
FIG. 7 is a graph illustrating the relationship between the engine speed and the power output of the prior engine of FIG. 6.

Below an engine speed C (FIG. 7), the reed valves 22a, 22b and 22c produce output characteristics such as shown by curve A in FIG. 7, because of the adequate amount of lift obtained even though the spring constant is small, without any restriction. When the engine reaches rotational speed C, the stoppers 30 rotate with the main shafts 25 and are brought into contact with the reed valves 22a, 22b and 22c. At this time, the effective free length of the reed valves 22a, 22b and 22c is shortened, whereby the spring constant increases. The output characteristics then become similar to the characteristics shown by curve B in FIG. 7 for the upper intermediate and high speed range above speed C. Thanks to the provision of the means for changing the spring constant in a forced manner during the operation of the engine, a high power output can be continuously obtained throughout the low speed to high speed range.

As can be seen from the description mentioned above, the device according to the present invention, which has a reed valve of a small spring constant, is capable of obtaining high output in all speed ranges because of the following. In the region of intermediate and high speed ranges in which a large spring constant is needed, the free length is shortened by closely contacting the stoppers with the reed valves having the small spring constant, due to the main shafts which transmit the rotational force of the motor with the use of the gear plates. Furthermore, since the mechanism transmitting the rotational force of the motor to the stoppers through the main shafts comprises the gear plates, power can be securely transmitted with little mechanical loss which would oocur at nodal points of the link mechanism. A still further advantage is that the contacting force with the reed valves is large because the main shafts are made of a flexible material and dampers are disposed between the main shafts and the stoppers, whereby the force required to effect contact can be kept small.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a reed valve device for a 2-cycle engine in which two reed valves which open and close an air intake passage are respectively secured in an opposing manner adjacent respective ends of a valve seat which is disposed in a transverse manner in said air intake passage, said air intake passage communicating with a crank chamber, the improvement comprising:

two rotatably supported main shafts;

stoppers which are adapted to be moved freely between positions in contact with and separated from surfaces of said reed valves and which are each secured to a respective one of said main shafts; and gear plate means which acts to rotate said pair of main shafts in a synchronized manner, said stoppers normally being separated from said reed valves and being brought into contact with said reed valves by the application of a rotational force to said main shafts when the engine speed reaches an intermediate or high speed range.

2. A reed valve device for a 2-cycle engine according to claim 1, wherein each said stopper is made of a flexible material or is covered with a plastic material.

3. A reed valve device for a 2-cycle engine according to claim 1, wherein a damper is disposed between each said main shaft and said stopper thereon.

4. A reed valve device for an engine, comprising: a housing having a surface thereon and having a port extending thereinto from said surface; a reed valve which is made of a piece of flat flexible material having two ends, which is normally disposed against said surface so as to obstruct fluid flow through said port, which has one of said two ends fixedly secured to said housing, and which by flexing of portions spaced from said one end can move to a position in which fluid can flow through said port; a stopper supported for movement between a first position spaced from said reed valve and a second position firmly engaging said reed valve at a location between said ends thereof; and means for moving said stopper between said first and second positions when the engine speed is respectively below and above a predetermined speed.

5. A reed valve device according to claim 4, wherein said means for effecting movement of said stopper includes a rotatably supported shaft and means for effecting rotational movement of said shaft between two positions when the engine speed is respectively below and above said predetermined speed.

6. A reed valve device according to claim 5, including a further port provided in said housing, including two said reed valves secured on said housing and each being capable of obstructing fluid flow through a respective said port, including two said shafts, including two said stoppers which are each supported on a respective said shafts and which can each engage a respective said reed valve, and including two operatively engaged gear plates which are each provided on a respective said shaft and which effect synchronized rotation of said shafts.

* * * * *